US010960510B2

(12) United States Patent
Stark et al.

(10) Patent No.: US 10,960,510 B2
(45) Date of Patent: Mar. 30, 2021

(54) DEVICE FOR ATTACHING DRIVE PLATES TO A POWERED FLOOR POLISHING MACHINE

(71) Applicant: DIAMOND PRODUCTIONS LTD., Montreal (CA)

(72) Inventors: Harvey Stark, Montreal (CA); Pavel Ikonomov, Laval (CA)

(73) Assignee: Diamond Productions Ltd., Montreal (CA)

( * ) Notice: Subject to any disclaimer, the term of this patent is extended or adjusted under 35 U.S.C. 154(b) by 365 days.

(21) Appl. No.: 16/153,033

(22) Filed: Oct. 5, 2018

(65) Prior Publication Data

US 2020/0108482 A1 Apr. 9, 2020

(51) Int. Cl.
*B24B 7/18* (2006.01)

(52) U.S. Cl.
CPC ..... *B24B 7/186* (2013.01)

(58) Field of Classification Search
CPC ... B24B 7/186; B24B 41/047; B24B 41/0475; F16C 21/00; F16C 21/005
USPC ..... 451/350, 352, 353
See application file for complete search history.

(56) References Cited

U.S. PATENT DOCUMENTS 4,319,434 A * 3/1982 Brejcha ..... B24B 41/047 15/49.1
4,328,645 A * 5/1982 Sauer ..... B24B 41/047 451/359
6,238,277 B1 * 5/2001 Duncan ..... A47L 11/16 451/271
7,481,602 B2 1/2009 Lampley et al.
8,251,780 B2 * 8/2012 Ward ..... B24B 7/186 451/353
2004/0082285 A1 * 4/2004 Bohler ..... B24B 23/02 451/359
2010/0175237 A1 * 7/2010 Luk-Tung ..... B24D 7/066 29/243

FOREIGN PATENT DOCUMENTS

KR 20130082235 A * 7/2013
WO WO-2018163102 A1 * 9/2018 ..... B24B 7/18

* cited by examiner

*Primary Examiner* — Monica S Carter
*Assistant Examiner* — Michael A Gump
(74) *Attorney, Agent, or Firm* — Thomas J. Nikolai; Dewitt LLP

(57) ABSTRACT

A device for attaching abrasive drive plates to the motor driver, rotatable arms of a floor finishing machine so that it can be used to grind and polish hardened concrete has a polygonal shaped driver member to which is affixed at least one abrasive drive plate using spherical bearings on its or their drive shafts so that it is or they are free to both spin and to tilt relative to a vertical axis. A locking cap containing a radial bearing may be affixed to housings for the radial bearings for constraining the drive plate shafts solely to pure rotation about the vertical axis. A plurality of channel members is affixed to an upper surface of the polygonal shaped driver for coupling it to the arms of the floor finishing machine.

6 Claims, 3 Drawing Sheets

DEVICE FOR ATTACHING DRIVE PLATES TO A POWERED FLOOR POLISHING MACHINE

CROSS REFERENCE TO RELATED APPLICATIONS

None

STATEMENT OF GOVERNMENT INTEREST

None

BACKGROUND OF THE INVENTION

I. Field of the Invention

This invention related generally to equipment for finishing concrete floors and other slabs and more particularly to an attachment for use with a floor treating machine for finishing hardened concrete by grinding and ultimately polishing it.

II. Discussion of the Prior Art

Others have disclosed the ability to convert a power trowel to a concrete finishing machine. The LAMPLEY U.S. Pat. No. 7,481,602 discloses such an invention. In the drawings and specification thereof there is described a circular pan. On the upper major surface thereof are brackets for affixing the pan to the blades or arms of a power trowel. Affixed to the lower side of the circular pan are radial or linear bearings, schematically represented in FIG. 1 of the patent drawings by a layer 40. In some undisclosed way, these bearings journal a plurality of backing plates 24 so that they are free to rotate with respect to the pan 26. The backing plates include diamond abrasives 22 on the bottom, floor-engaging surface thereof.

As is further explained in the LAMPLEY '602 patent, an intermediate layer 28 is disposed between the backing plates 24 and rotating attachments 40. The intermediate layer is disclosed as being a spongey plastic or rubber material the purpose of which is to allow the diamond bearing backing plates to deform into and ride over irregularities in the concrete surface being finished once the concrete has been allowed to harden.

The present invention is deemed to be a significant improvement over the LAMPLEY device in that it provides a superior method of controlling the way in which diamond abrasives are allowed to interact with the concrete surface being finished. Rather than relying upon a sponge rubber layer to provide some limited flexibility to the backing plates as in the LAMPLEY '602 patent, we have devised a bearing mounting arrangement for the abrasive backing plates that selectively can be made to angulate about a vertical axis as irregularities in the floor surface are encountered or the shaft can be locked so as to be only able to spin about a vertical axis. In this way, the floor can initially be treated with the backing plates free to angulate so as to eliminate bumps and depressions in the concrete, followed by operation in the lock mode to polish the surface once the irregularities have been eliminated.

SUMMARY OF THE INVENTION

The present invention comprises a device for coupling abrasive drive plates to the rotatable arms of a floor grinding/ polishing machine. A sheet metal driver with a polygonal shape in its plan view has an upper major surface and a lower major surface. Affixed to the upper major surface are channels for joining the driver to the arms or blades of the floor treating machine. Also mounted on the upper major surface of the driver is at least one bearing housing containing a spherical bearing for journaling a shaft to which is attached a backing plate having an abrasive on its bottom surface. The spherical bearing allows the shaft and backing plate to spin about a longitudinal axis of the shaft and for that longitudinal axis of the shaft to angulate or swing through an arc as the power trowel with the device of the present invention affixed is swept over the concrete floor surface being treated.

Further included is a locking cap containing a ball bearing which when bolted to the top of the bearing housing constrains the shaft to rotation solely about a vertical axis.

DESCRIPTION OF THE DRAWINGS

The foregoing features, objects, and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
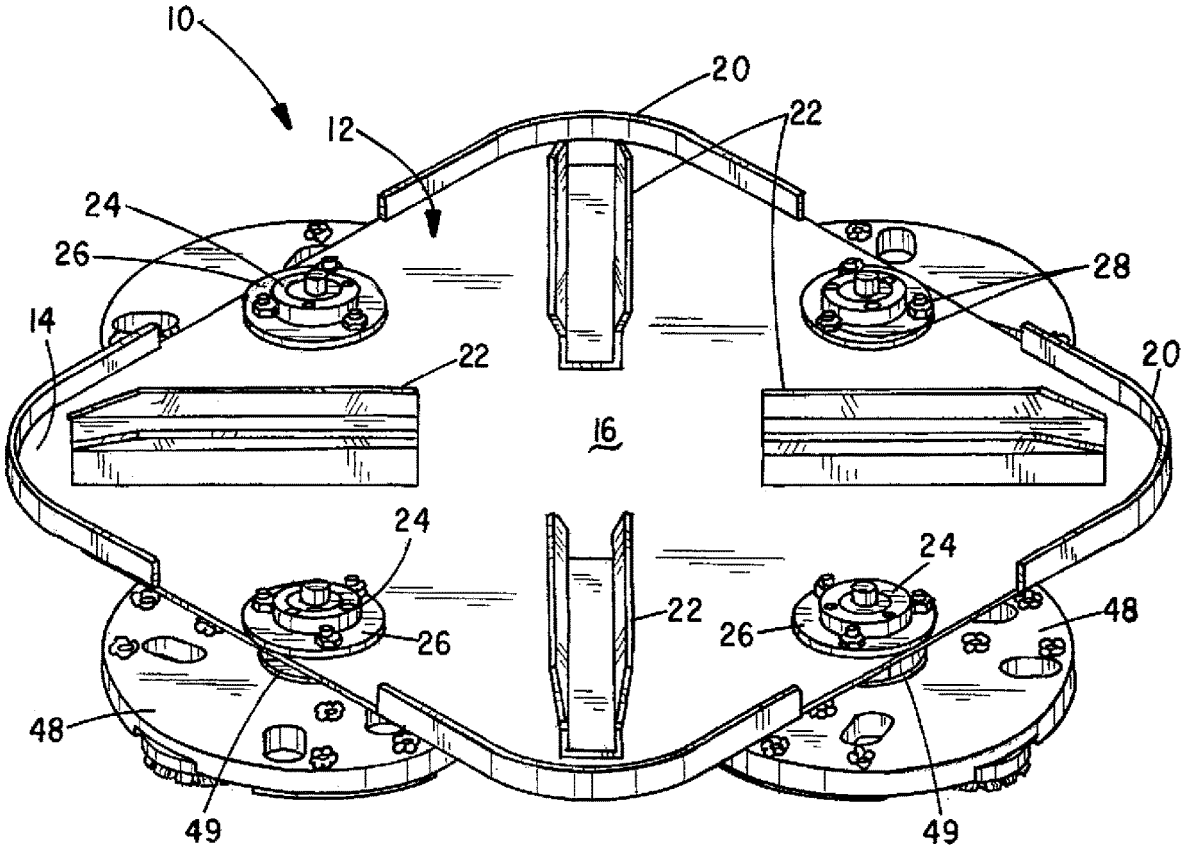
FIG. 1 is a top perspective view of the device for attaching drive plates to rotatable arms of a floor treating machine.

This invention is being described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

This description of the preferred embodiments is intended to be read in connection with the accompanying drawings, which are to be considered part of the entire written description of the invention. In the description, relative terms such as "lower", "upper", "horizontal", "vertical", "above", "below", "up", "down", "top", "bottom", and derivatives thereof (e.g. "horizontally", "downwardly", "upwardly", etc.) should be construed to refer to the orientation as then described or shown in the drawings under discretion. These relative terms are for convenience of description and do not require that the apparatus be constructed or operated in a particular orientation. Terms such as "connected", "connecting", "attached", "attaching", "join", and "joining" are used interchangeably to refer to one structure or surface being secured to another structure or surface or integrally fabricated in one piece, unless expressly described otherwise.

In accordance with one preferred embodiment, a device for attaching rotatable, abrasive carrying drive plates to the rotatable motor drive arms of a floor treating machine is indicated generally by numeral 10 and is seen to comprise a polygonal shaped driver 12, here shown as a rectangle or square having rounded corners as at 14. The polygonal driver 12 has an upper major surface 16, a lower major surface 18, and corner walls 20 projecting upward from the surface 16 of the driver 12. The walls serve to ease removal of the assembly from beneath the machine (not shown) to which the assembly may be attached. The side walls further serve to distribute water flowed during polishing operations from the driver 12 onto the floor.

Welded or otherwise attached to the upper major surface 16 is a plurality of U-shaped channels 22, preferably of steel, allowing them to be snapped onto the arms of a motor driven floor treating machine.

Figure 3:
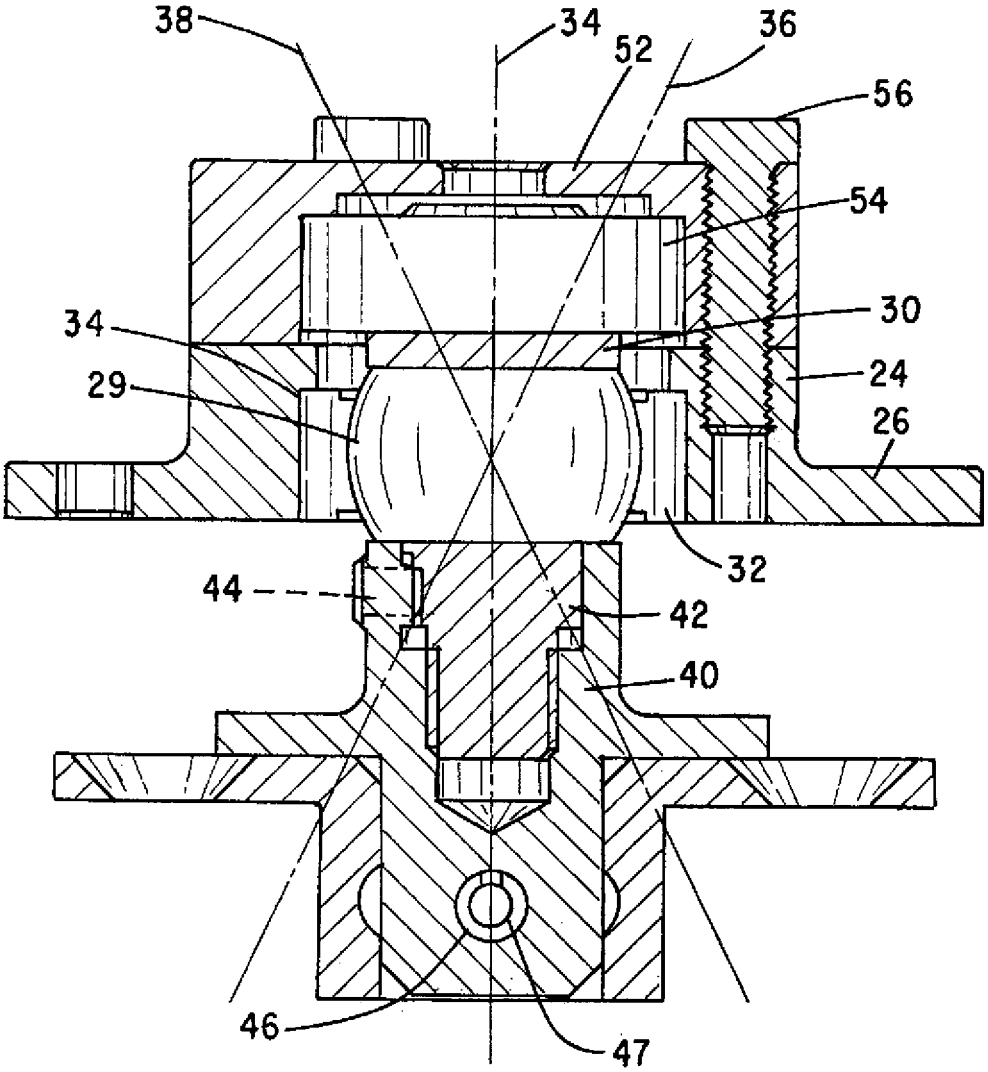
FIG. 3 is a cross section view of the bearing assembly for journaling the abrasive backup discs to a mounting pan.

With continued reference to FIG. 1, there is also attached, midway along the four edges of the driver 12, bearing housings, as at 24, and more particularly shown in the cross sectional view of FIG. 3. Bearing housing 24 includes a radial flange 26 allowing the housing to be bolted to the driver 12 using sheet metal screws or bolts 28.

As seen in FIG. 3, bearing housing 24 contains a spherical bearing 29 mounted on an elongated shaft 30. Its outer race 32 fits into a central bore 34 of the bearing housing 24. As such, the shaft 30, when unconstrained, can not only spin about its longitudinal axis, but the shaft 30 may also tilt through a 360 cdegree arc as represented by the dashed lines 36 and 38.

Fitted onto the lower end 42 of the shaft 30 is a quick connect member 40. The quick connect member 40 has a central bore 42 shaped to fit about the lower end portion 42 of the shaft 30 and is preferably secured thereto by means of a set screw 44. The quick connect device 40 includes a conventional spring ball detent 47 inserted into a transversely extending bore 46 that serves to retain a drive plate 48 (FIG. 1) thereon. The drive plate 48 has a central hub 49 with a female socket (not shown) for receiving the device 40 and the spring ball cooperates with a dimple or groove in the wall of the socket to resist unwanted decoupling of the backing plate from the quick connect 40.

Figure 2:
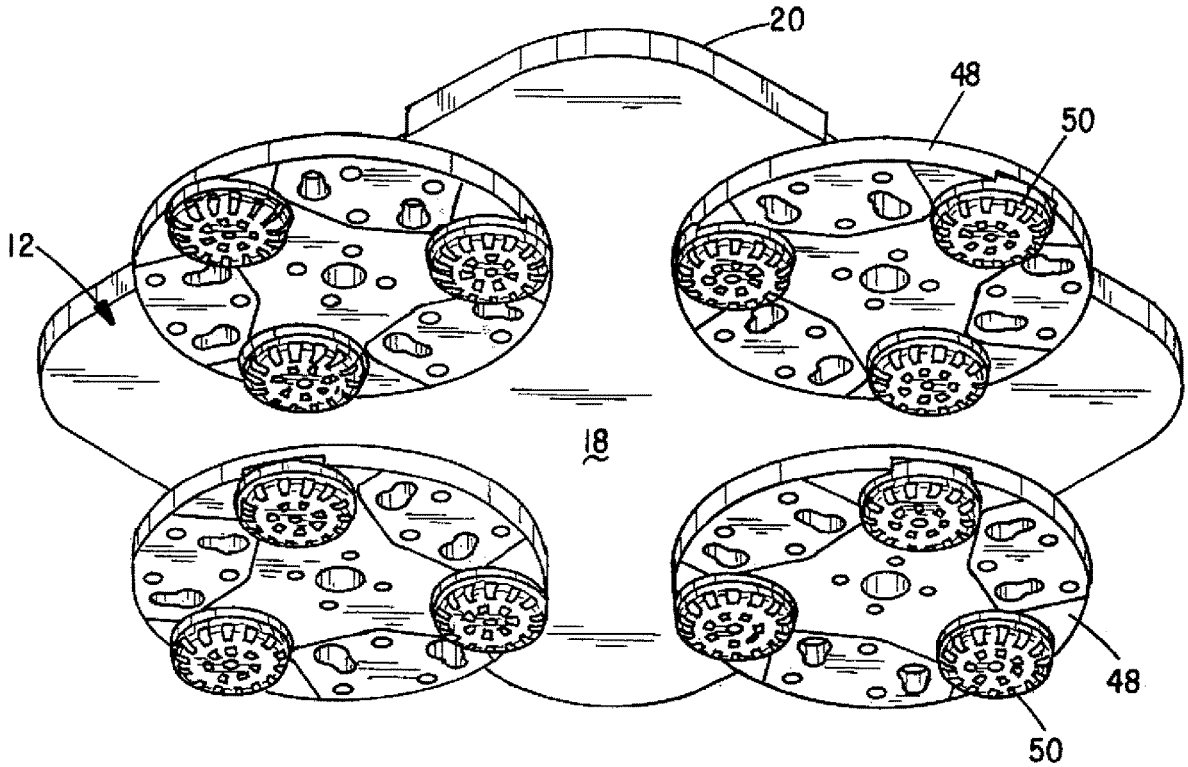
FIG. 2 is a bottom perspective view thereof.

As is best seen in FIGS. 1 and 2, the drive plates 48 preferably comprise circular discs, each with a central hub 49 having a socket adapted to receive the quick connect device 40 therein. Upon insertion of the quick connect into the socket of the central hub 49 of the backing discs, the ball first compresses then re-expands into a dimple or groove formed internally of the hub to retain the backing plate on the elongated shaft 30. The backing plate can be readily removed without the use of tools by pulling on the disk with sufficient force to overcome the resistance afforded by the spring ball detent.

Referring now to FIG. 2, it may be seen that the backing plates 48 each include abrasive tools 50 on the bottom surface thereof. They are preferably secured by hook and loop material adhesively bonded to the mating faces of the backing plates and abrasive tools 50, but alternative devices for affixing abrasives to drive plates known in the art may also be employed.

Those skilled in the art can appreciate that by employing a spherical bearing, as at 29, in the bearing housing 24, the drive plates 48 carrying the abrasives 50 are able to tilt in all directions about a central, vertical axis and this has been found to be extremely effective in smoothing out irregularities in the concrete surface being treated.

In some uses of the present invention, it may be desired to constrain the tilting action afforded by the spherical bearing so that the drive plates remain parallel to the surface of the concrete being addressed. To achieve this result, there is provided a locking mechanism, identified in FIG. 3 as comprising a lock cap 52 and a deep groove, single, row ball bearing 54 held in place by cap screws, as at 56. More particularly, an inner race of the ball bearings 54 fits about the upper end of the shaft 30 and the outer race of the ball bearings 54 fits into a bore in the cap 52. When this lock mechanism is bolted in place, the shaft 30 is only free to spin about the longitudinal axis 34 and is precluded from tilting.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices.

What is claimed is:

1. A device for coupling an abrasive drive plate to a powered floor treating machine comprising:

a. a driver member having upper and lower major surfaces;

b. at least one bearing housing affixed to the upper major surface of the driver member;

c. a plurality of channels on the upper major surface of the driver member, said channels adapted to connect the driver member to motor driven arms of a powered floor treating machine;

d. a cylindrical drive shaft having a longitudinal axis and extending through an aperture formed in the driver member, said drive shaft adapted to be joined to a drive plate, the drive plate having a lower surface with at least one abrasive element affixed thereto; and e. a spherical bearing for journaling the drive shaft in the at least one bearing housing whereby the drive shaft may rotate about its longitudinal axis as the drive shaft angulates through a predetermined arc with respect to the vertical; and f. a radial bearing having an inner race affixed to an upper end of the drive shaft and a lock cap attached to the at least one bearing housing and to an outer race of the radial bearing for constraining the drive shaft to rotation about a vertical axis.

2. The device of claim 1 and further including a quick connect lock shaft affixed to a lower end of said drive shaft for releasably coupling the drive shaft to a central hub of the drive plate.

3. The device of claim 1 wherein the driver member is a polygon in its plan view.

4. The device of claim 3 wherein the polygon is a rectangle.

5. The device of claim 1 wherein a plurality of said bearing housings are affixed to the upper major surface of the driver member, each containing a spherical bearing for journaling further ones of said cylindrical drive shafts extending through associated apertures in the driver member, each of said further cylindrical drive shafts adapted to be joined individually to a drive plate, and wherein a lock cap is provided for selected ones of the plurality of bearing housings wherein each of the lock caps contains a radial bearing for journaling an associated drive shaft for rotation solely about a vertical axis and wherein, when the lock cap is removed, its associated drive shaft is free to simultaneously spin about and tilt away from the vertical axis.

6. The device of claim 5 wherein each of the drive plates has at least one abrasive element on a lower surface thereof.

* * * * *